United States Patent [19]

Williams, III

[11] Patent Number: 5,031,831

[45] Date of Patent: Jul. 16, 1991

[54] DEVICE FOR COOLING POTABLE LIQUIDS

[76] Inventor: Joseph I. Williams, III, 701 Pitt St., Mt. Pleasant, S.C. 29464

[21] Appl. No.: 480,766

[22] Filed: Feb. 7, 1990

[51] Int. Cl.[5] ..... A47G 21/18

[52] U.S. Cl. ..... 239/33; 62/338; 62/440

[58] Field of Search ..... 62/371, 372, 457.2, 62/457.3, 338, 294; 239/33, 132, 132.1, 132.3

[56] References Cited

U.S. PATENT DOCUMENTS

| | | | |
|---|---|---|---|
| 2,248,231 | 7/1941 | Hamilton | 239/33 |
| 2,288,848 | 7/1942 | Schuessler | 239/33 |
| 3,302,428 | 2/1967 | Stoner et al. | 62/371 |
| 3,520,148 | 7/1970 | Fuerle | 62/371 |
| 3,718,282 | 2/1973 | Pizzoferrato | 239/33 |
| 3,995,445 | 12/1976 | Huskins | 62/371 |
| 4,196,817 | 4/1980 | Moser | 62/372 |
| 4,628,703 | 12/1986 | Kim | 62/371 |
| 4,638,645 | 1/1987 | Simila | 62/371 |
| 4,658,990 | 4/1987 | Ramage | 239/33 |
| 4,850,533 | 7/1990 | Hoshi et al. | 239/33 |

*Primary Examiner*—Andres Kashnikow
*Assistant Examiner*—Christopher G. Trainor

[57] ABSTRACT

A device is disclosed herein which will cool potable liquids by running the material through capillary tubes which themselves are cooled by various cooling materials. As a result, by the time the liquid is sipped from the straw and through the wound capillary tubes it will have cooled to a point as if it had been refrigerated in its original container.

6 Claims, 5 Drawing Sheets

DEVICE FOR COOLING POTABLE LIQUIDS

BACKGROUND OF THE INVENTION

This invention relates to cooling potable liquids through a straw by having the capillary tube of the straw wound around and run through various cooling materials so that by the time the liquid is transferred from its initial container to the mouth of the drinker, it has cooled to a point as if the entire container had been refrigerated.

In order to have a cold drink when one is outside of the home, it is necessary to do one of three things:

1. Buy a cold drink from a store and drink it before it warms up;

2. Pour a warm drink over ice that has been carried with you; or

3. Carry a refrigerated cooler or one filled with ice in order to keep the drinks cold.

Obviously, this presents problems:

a. If one is not near a store;

b. One does not wish to drink the drink immediately after purchasing same;

c. One does not have ice;

d. One does not wish to carry a cooler around.

This invention is intended to eliminate all of the above problems and allow an individual to partake of a cold drink in any location without the inconvenience of carrying a cooler or ice, or having to be near a store which sells cold drinks. This is a particular advantage to hikers, fishermen, golfers, picnickers, beachgoers, commuters, travellers, or anyone in the position of wanting a cold drink but not having one of the above three facilities or time to stop to purchase a cold drink.

Until the present invention, there has not been an economical and efficient way to have a cold drink while not near either a cooler, ice, or store. This device which is disclosed herein will cool liquids from such items as cans or other containers without great expense or inconvenience.

SUMMARY OF THE PRESENT INVENTION

Disclosed herein is a device which will cool potable liquids such as canned soft drinks or other such liquids so that warm beverages may be carried or purchased and later consumed as if they had been refrigerated.

FIGS. 1, 2, 3, 4 and 5 show the basic configurations in which the device can be constructed.

DETAILED DESCRIPTIONS OF THE DRAWINGS

CONSTRUCTION

Figure 1:
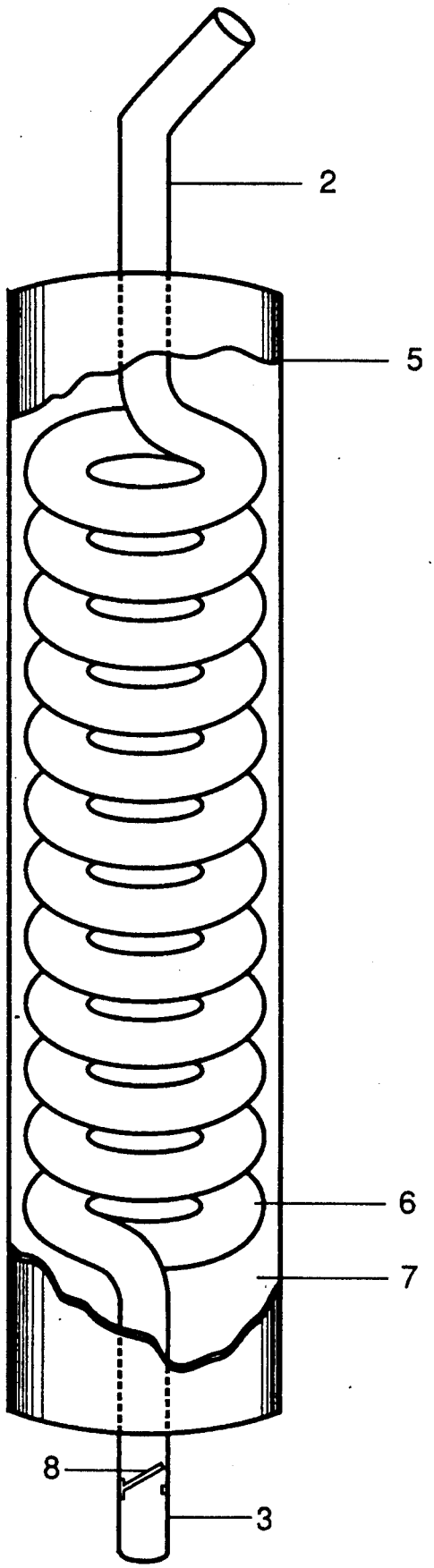
FIG. 1 shows the perspective view of the device with a frozen substance used as the coolant, by dividing the cylinder shown in FIG. 1 into two separate compartments it can then be used for the endothermic reaction.

The primary material for construction of the device is plastic, in the type commonly used in sipping straws and which are compatible for liquid consumption by humans. The pressurized device would be constructed out of thin walled metal as is commonly used in the construction of seamless soft drink cans. As more fully set forth in the drawing marked FIG. 1, there is a straw of standard dimensions, approximately two inches in length at the top 2 and bottom 3 (and one-quarter inch in diameter) of a cylinder 5 which is three-eighths inch in outside diameter or larger and five to six inches in length according to its construction. The cooling of the liquid takes place in this cylinder.

The inside of the cylinder 7 houses a continuously wound up capillary tube 6 constructed with a very thin walled material in order to improve cold temperature transfer. The length of this inside capillary tube 6 can vary from five inches to twenty inches depending upon the size of the tube constructed and the amount of the space available in the cylinder. The length of the tube and the thickness of its wall would directly affect the cooling of the liquid drawn through it.

To improve cold transfer the inside capillary tube 6 can also be constructed of a stainless metal. This would greatly improve the cooling of the liquid drawn through the cylinder. This would make the tube non-disposable. If a plastic material is used this would allow the device to be disposable.

MODE OF OPERATION

In FIG. 1 when the warm liquid is drawn from the can, cup, or glass by a normal sucking action of the mouth upon the top of the straw 2, the liquid then enters the bottom two inch section of the straw 3 and then enters the four to five inch long, three-eighths inch or larger diameter cooling chamber 5.

The warm liquid then runs through the continuous capillary tube 6 inside the cooling chamber 7 which is filled with various materials as more fully set forth in the section on cooling which follows herein.

The length of the capillary tube 6 runs from five inches to twenty inches according to what mode of construction is to be used.

Figure 2:
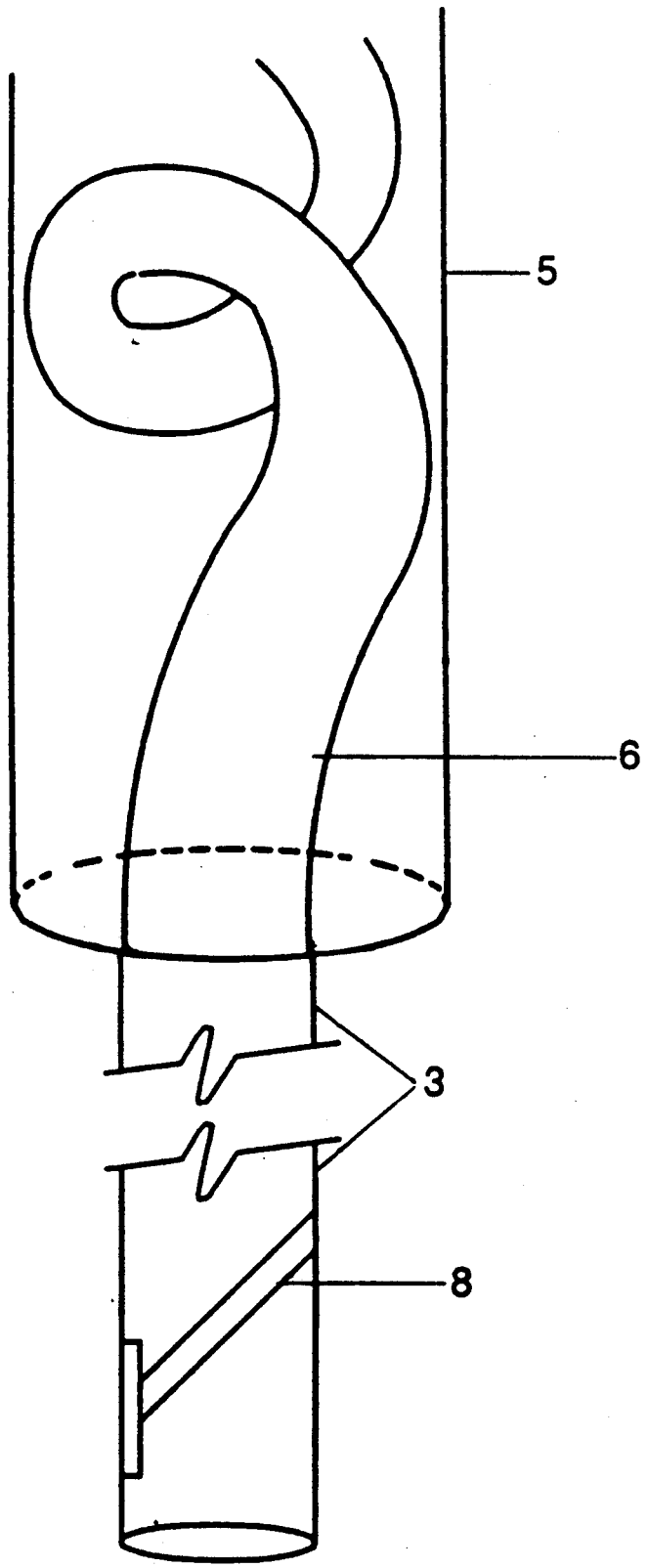
FIG. 2 shows an enlarged section of the intake device with the inside flapper valve in closed position.

As shown in FIG. 2, there is a one way flapper valve 8 at the bottom of the two inch intake straw 3. The purposes of this valve 8 is to counteract the natural tendency of liquid to fall back down a straw once the pressure is stopped or decreased, as when the sucking action of the drinker ceases.

Since the capillary tube 6 will be filled with liquid, each progressive sip will be cooler due to the more extended time the subsequently sipped liquid will remain in the capillary tube surrounded by the cooling chamber.

METHOD OF COOLING

The method of cooling is accomplished by four methods, two of which are disposable.

1. In FIG. 1 the area 7 in the cooling chamber 5 around the capillaries 6 is filled with water. Prior to using the device, it is put in a freezer where is it frozen and then used when needed. This method would allow one to use and reuse the device with good results for approximately one hour after removing same from the freezer.

2. In FIG. 1 the area 7 in the cooling chamber 5 is filled with a gelatinous nontoxic substance, such as Igloo Ice, glycerol or any substance with a freezing point of zero degrees Fahrenheit. This is also cooled in a freezer prior to use and would allow approximate using time from removal from the freezer of approximately three hours. As with the first device, it too is reusable.

3. In FIG. 1 the area 7 in the cooling chamber 5 around the capillaries is filled with ammonium nitrate. A separate chamber holds water which when the two materials are released and mixed together, create a chemical reaction which is endothermic in nature. As a result of this reaction severe cold results. This device is completely portable and can be carried and/or activated when desired. This device would be of disposable construction, so that it could only be used one time.

Figure 3:
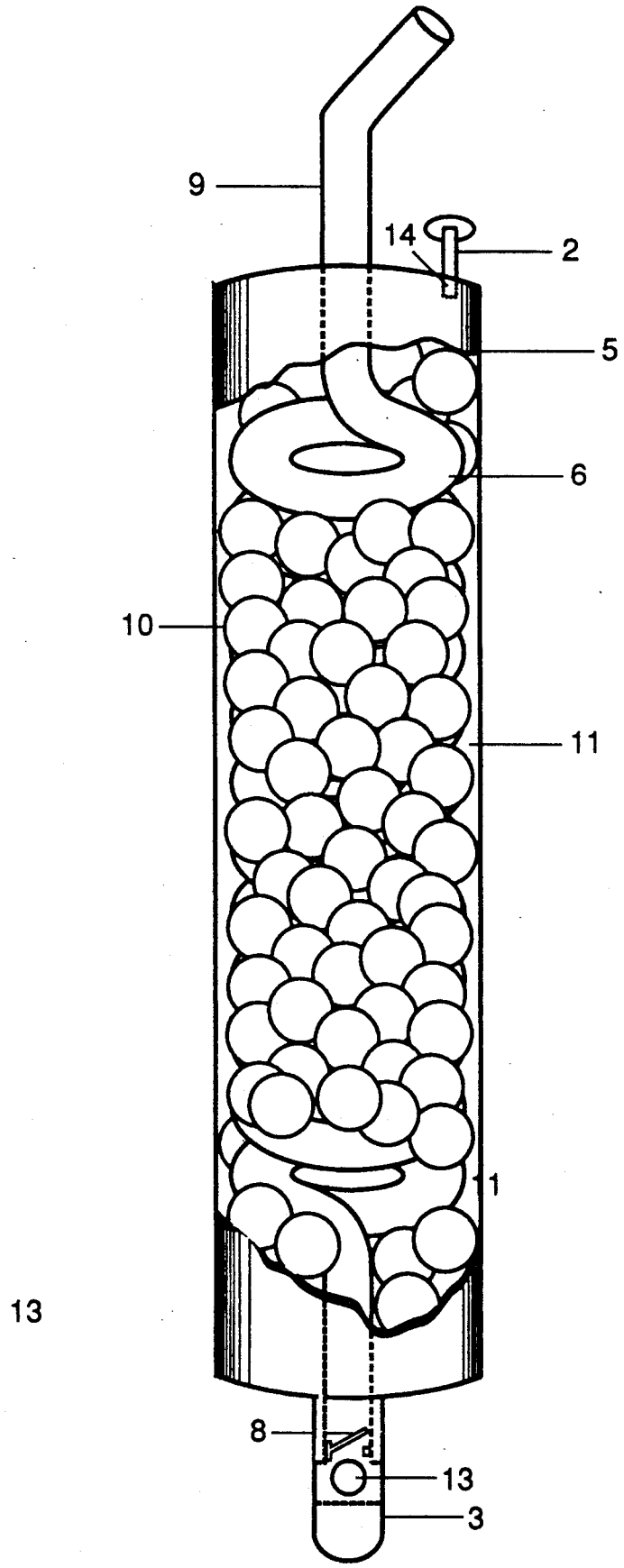
FIG. 3 shows a perspective view of the device with freon or $CO_2$ used as the coolant and metal spheres used as the negative temperature retaining and transfer mechanisms.
Figure 4:
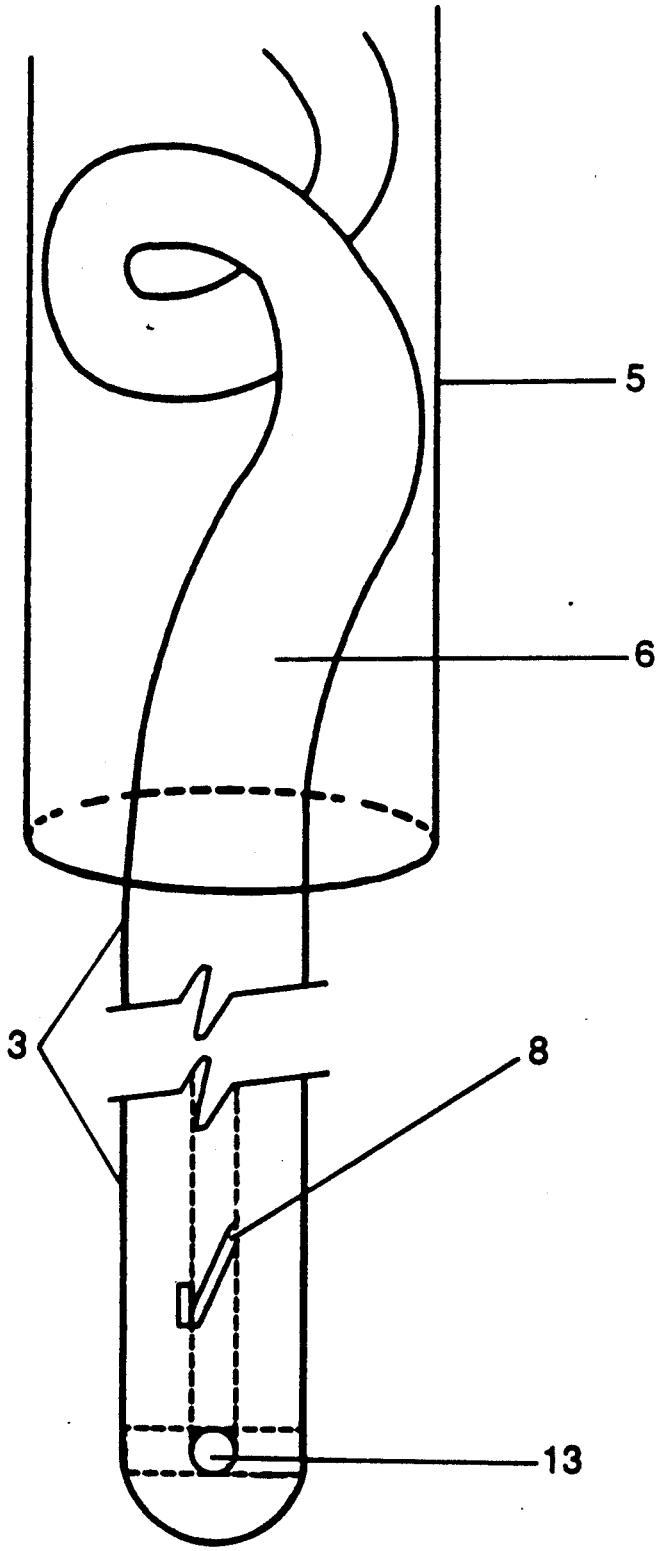
FIG. 4 shows another embodiment of the intake device with flapper valve. The liquid would flow into the sides and not the bottom eliminating any backpressure.

4. As more fully set forth in FIG. 3, the entire apparatus is made of metal including the casing 5 and the inside capillary tube. The mouth and top straw section 9 of the tube is made of plastic. The chamber 5 is filled with small copper or similar metal spheres 10 which have the physical property of being able to retain cold.

Figure 5:
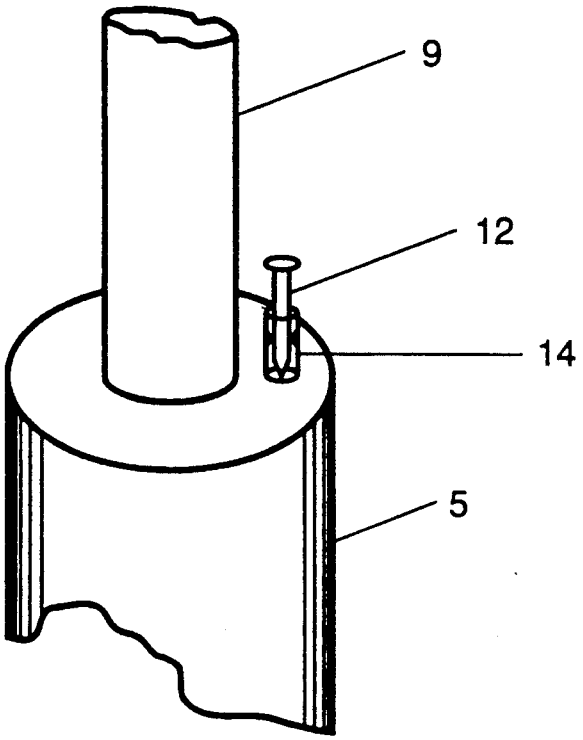
FIG. 5 shows an exploded section of FIG. 3 depicting the seal puncture mechanism and gas escape holes.

The intake device 3 is a small one-quarter inch cylinder with four intake holes 13 on the sides. The metal case 5 is filled with compressed gas 11 comprised of freon, carbon dioxide or other similar gaseous material which is maintained under pressure. When the seal 12 is snapped open the gas escapes through a small opening 14. FIG. 5 shows the seal 12 and gas escape holes 14 in larger detail. This reduction in pressure causes an immediate and severe drop in temperature of the case 5 metal spheres 10 and inside tube 6.

After releasing the gas and cooling the chamber, 5 the entire device is placed into the opening of the beverage can or other such container. The liquid is then sucked through the top opening of the straw 9. The device is constructed so that the liquid only run through the capillary tube 6 and does not make direct contact with the cooling gaseous material 11, the metal case 5, or the metal spheres 10.

The cooling occurs two ways. First, the metal cylinder 5 cools the liquid by contact. Second, as the liquid is drawn through the capillary tube 6 which is surrounded by cold metal spheres, 10 it is reduced in temperature again. This device would be of disposable construction, so that it could only be used one time.

What is claimed is:

1. A straw for cooling potable liquids passing through the straw comprising a hollow top portion, a hollow bottom portion, a wound up capillary portion interconnecting the top portion with the bottom portion, and a cooling chamber, said cooling chamber extending about the exterior of said wound up capillary portion, and wherein said cooling chamber contains a cooling medium, said cooling medium contacting the exterior of said capillary portion to thereby cool the liquid passing through the straw.

2. A straw as set forth in claim 1 further comprising a check valve in said bottom portion.

3. A straw as set forth in claim 1 further comprising intake means, said intake means comprising a plurality of intake holes disposed in a side wall of the bottom portion.

4. A straw as set forth in claim 1 wherein said cooling medium as water and said water is frozen by placing the straw in a freezer.

5. A straw as set forth in claim 1 wherein said cooling medium is a gelatinous nontoxic substance, said substance being cooled by placing the straw into a freezer.

6. A straw as set forth in claim 1 further comprising a small hole passing through a wall of said cooling chamber, a seal covering said small hole, and a plurality of metal spheres contained within the cooling chamber, said cooling medium comprising compressed carbon dioxide or freon, and wherein upon removal of said seal from covering said hole, depressurization of said cooling chamber causes a reduction in the temperature of the metal spheres and the cooling chamber.

* * * * *